US007520417B2

(12) United States Patent
Biedermann et al.

(10) Patent No.: US 7,520,417 B2
(45) Date of Patent: Apr. 21, 2009

(54) FOOD CONTAINER WITH A HOLDER FOR A CONDIMENT CUP

(76) Inventors: Markku Biedermann, 1111 Brickell Bay Dr., Apt. 3212, Miami, FL (US) 33131; Andres Kozhaya, 3201 NE. 183rd St., Apt. 3008, Aventura, FL (US) 33160; Xavier Velez, 5561 NW. 112th Ave., Apt. 104, Doral, FL (US) 33178; Krystle Kimmons, 940 Nightngale Ave., Miami Springs, FL (US) 33166; Thomas Kuhn, 1527 Albenga Ave., Bldg. 6-202B, Coral Gables, FL (US) 32826; Jaime Buitrago, 400 Warren La., Key Biscayne, FL (US) 33149

( * ) Notice: Subject to any disclaimer, the term of this patent is extended or adjusted under 35 U.S.C. 154(b) by 0 days.

(21) Appl. No.: 11/936,925

(22) Filed: Nov. 8, 2007

(65) Prior Publication Data

US 2008/0237327 A1 Oct. 2, 2008

Related U.S. Application Data

(60) Provisional application No. 60/911,637, filed on Apr. 13, 2007, provisional application No. 60/909,049, filed on Mar. 30, 2007.

(51) Int. Cl.
*B65D 3/24* (2006.01)
*B65D 3/28* (2006.01)

(52) U.S. Cl. ..... 229/120.15; 206/216; 206/815; 229/400; 229/904; 229/906

(58) Field of Classification Search ..... 229/160.2, 229/242, 400, 90, 904, 906, 120.15; 220/23.4; 206/216, 541, 564, 565, 815
See application file for complete search history.

(56) References Cited

U.S. PATENT DOCUMENTS

| | | | | |
|---|---|---|---|---|
| 2,758,774 | A * | 8/1956 | Grunert et al. | 229/117.07 |
| 3,442,435 | A | 5/1969 | Ludder et al. | |
| 3,737,095 | A * | 6/1973 | Derauf | 229/232 |
| 4,491,220 | A * | 1/1985 | Daviss | 206/217 |
| 4,854,466 | A | 8/1989 | Lane, Jr. | |
| 4,915,235 | A | 4/1990 | Roosa | |
| 4,955,528 | A | 9/1990 | Schluckebier | |
| 5,213,255 | A * | 5/1993 | Cote | 229/115 |
| 5,417,364 | A | 5/1995 | Shaw | |

(Continued)

*Primary Examiner*—Gary E Elkins
(74) *Attorney, Agent, or Firm*—Robert M. Schwartz; David W. Barman

(57) ABSTRACT

A food container in combination with a condiment container having a lip, a lower lip edge and a top edge. The food container includes at least one wall. A bottom connected to the wall defines a containment space. A slit formation is formed in the wall, the slit formation has a lower slit and an upper slit substantially parallel to the lower slit. The slits define a loop that is displaceable into the containment space for supporting the condiment container by urging the condiment container against the wall. The lower slit defines a wall lower ledge disposed for supporting the lower lip edge of the condiment container.

9 Claims, 9 Drawing Sheets

U.S. PATENT DOCUMENTS 5,429,262 A 7/1995 Sharkey
5,626,283 A 5/1997 Mellon
5,630,544 A 5/1997 Shane
5,667,119 A 9/1997 Florence
5,676,990 A 10/1997 Wawrzynski
5,720,429 A 2/1998 Cordle
5,722,558 A 3/1998 Thompson
5,775,570 A 7/1998 Kim
5,842,631 A 12/1998 Berger
6,062,468 A 5/2000 Tausanovitch
6,089,375 A 7/2000 Johnson et al.
6,102,208 A 8/2000 Huang
6,119,930 A 9/2000 Lunstra et al.
6,152,362 A 11/2000 Rosenfeld
6,182,890 B1 2/2001 Sattler et al.
6,216,946 B1 * 4/2001 Cai ..... 229/400
6,230,969 B1 5/2001 Spran
6,360,944 B1 3/2002 Gorman
6,386,443 B1 5/2002 Szczerbinski
6,394,297 B1 5/2002 Nance
6,394,338 B1 5/2002 Sludeer
6,401,927 B1 6/2002 Sorensen et al.
6,419,153 B1 7/2002 Maita
6,427,864 B1 8/2002 Asselin
6,439,452 B1 * 8/2002 Tsao ..... 229/120.15
6,471,119 B2 10/2002 Cai
6,533,233 B2 3/2003 Thomas
6,612,485 B2 9/2003 Lackner et al.
6,719,192 B2 4/2004 Barcat et al.
6,755,305 B2 6/2004 Nance
7,140,532 B2 11/2006 Holt et al.
2003/0141355 A1 * 7/2003 McLean, III ..... 229/120.15
2005/0045708 A1 3/2005 Bodary et al.

* cited by examiner

FOOD CONTAINER WITH A HOLDER FOR A CONDIMENT CUP

CROSS-REFERENCE TO RELATED APPLICATIONS

This application claims the benefit of U.S. Provisional Patent Application Ser. No. 60/911,637, filed on Apr. 13, 2007, entitled Food Scoop With Condiment Holder; and the benefit of U.S. Provisional Patent Application Ser. No. 60/909,049, filed Mar. 30, 2007, entitled Food Scoop With Condiment Holder, the prior applications are herewith incorporated by reference in their entirety.

BACKGROUND OF THE INVENTION

1. Field of the Invention

The present invention pertains to a food container for holding French fries, onion rings, or other food items. Food containers of this type are typically made from folded paper product. More specifically, to a food container having a holder for a condiment cup.

2. Description of the Related Art

Food containers of this type typically have a bottom and sides for holding fries and the like. The containers may be configured to have a cylindrical shape so that they can be held in the cup holder of a vehicle.

U.S. Patent Application Publication 2003/0141355 A1 to McLean, III discloses a food and condiment holder for French fries. The food holder is a paper product that has two slits formed in a sidewall thereof forms a loop for holding a condiment container. McLean discloses the use of a specific condiment container that is constructed to match the profile of the wall and to have a bottom that rests on the bottom of the food container. McLean does not disclose that lip of the condiment container interacts with the slit in the wall for holding the condiment container in place. McLean does not disclose that the loop supports the condiment container.

U.S. Pat. No. 6,386,443 B1 to Szczerbinski discloses a combination food and condiment dispenser the food dispenser has a side panel with a cutout portion for holding the condiment container. The condiment container includes a clip structure at its top for attaching and suspending the condiment container to the side panel of the food container. Szczerbinski does not disclose that lip of the condiment container interacts with the cutout portion in the wall for holding the condiment container in place. Szczerbinski does not disclose that the loop supports the condiment container.

The disadvantages of the food containers and condiment containers as described above are condiment containers must be constructed specifically for use with the food container. The food containers are not constructed for use with a commonly produced round condiment container. Furthermore, the condiment containers are not secured in a direction out of the container.

SUMMARY OF THE INVENTION

It is accordingly an object of the invention to provide a food container which overcomes the above-mentioned disadvantages of the heretofore-known devices of this general type and which provides a food container that is more versatile, more economical to produce and easier to use.

The loop is constructed so that when it is fully extended inward into the enclosure, the shortest distance between the middle point of the two corners and the middle point of the loop is less than the diameter of the condiment container that it is configured to hold. This form-fitted construction creates a force resulting from the natural tendency of the material to hold its flatness property that holds the condiment container in place. When the loop is extended inward an opening is created on the upper back wall of the container and support ledges are created on both side of the opening at the top of the wall. The lower wall ledge creates a support mechanism that prevents the condiment container from moving out of place when pressure is applied into the container. The upper wall ledge supports the lip of the condiment container even in the extreme case that the food and condiment container combination is turned upside down and shaken, even in this case the condiment container stays in place.

The opening provides the necessary space for the user to push the loop inward into the containment space with a finger. When pushed inward, the slits create a loop that together with the two corners created by the semi-circular cutout serve as a support system for the condiment container.

The location of the cutout formation portion plays a determinant role, since by being on the upper back panel or wall of the food container the cutout portion provides a convenient location for utilization. The high location provides the opportunity to push the slits inward and attach the condiment container to the food container even if the food container is filled with food. When the loop is pushed inward by the user, the loop pushes the food creating the space for the condiment container. By attaching the condiment container to the food container after the food has been placed in the food container, it is guaranteed that the amount of food contained in the food container does not decrease. The reason is that the location of the condiment container results in a greater space utilization of the enclosure created by the food container. The location of the condiment container ensures that the food and condiment container combination can be physically maintained in a vertical position when placed in a flat surface. The location of the condiment container enhances the probability that the condiment will fall inside the enclosure created by the food container in the case that the food container or the condiment container fall. In addition, the push design of the holder ensures that the operation is performed from outside the container, and thus guarantees that the user does not make undesired contact with the food. Thus, the food container is safe for handling by a third party.

The present invention allows attaching and detaching the condiment container easily from the food container in the cases that the food container is with or without food. The present invention does not constrain the pouring of the condiment in the condiment container. The condiment can be poured before or after the condiment container is attached to the food container. The present invention does not alter the shape of the food container, thus, in the case and that the user decides not to place the condiment container in the food container, the food container functions as it would without the present invention incorporated. The condiment container does not need to possess any special construction. The common rounded tapered condiment container found in most fast food restaurants works ideally with the invention without the need for any changes or additional elements.

With the foregoing and other objects in view there is provided, a food container in combination with a condiment container having a lip, a lower lip edge and a top edge. The food container includes at least one wall. A bottom connected to the wall defines a containment space. A slit formation is formed in the wall, the slit formation has a lower slit and an upper slit substantially parallel to the lower slit. The slits define a loop that is displaceable into the containment space for supporting the condiment container by urging the condiment container against the wall. The lower slit defines a wall lower ledge disposed for supporting the lower lip edge of the condiment container.

In accordance with another feature of the invention, the upper slit defines a loop edge and is spaced from the lower slit to allow the loop edge to engage the lower lip edge.

In accordance with an additional feature of the invention, the upper slit defines a wall upper edge configured to engage the top edge of the condiment container when the condiment container is held in the containment space by the loop.

In accordance with yet an additional feature of the invention, the slits have a length that defines a loop distance, the loop distance is the largest distance between the wall and the loop. The loop distance is less than an outside diameter of the condiment container.

In accordance with a further feature of the invention, the lower slit includes a semi-circular slit at a middle of the lower slit. The semi-circular slit defines an opening in the wall that allows a finger to push the loop into the containment space.

In accordance with yet another feature of the invention, the semi-circular slit defines a tab on the loop.

In accordance with still yet another feature of the invention, the semi-circular slit and the lower slit define a removable tab.

In accordance with still a further feature of the invention the at least one wall is a plurality of connected walls. The slits are confined to one of the plurality of walls.

In accordance with still another feature of the invention the semi-circular slit defines two points on the wall at the lower slit. The points are positioned to support the lower lip edge of the condiment container.

With the objects of the invention in view, there is also provided a food container in combination with a condiment container having a lip, a lower lip edge and a top edge. The food container includes at least one wall. A bottom connected to the wall defines a containment space. A slit formation is formed in the wall. The slit formation has a lower slit and an upper slit substantially parallel to the lower slit. The slits define a loop that displaceable into the containment space for supporting the condiment container by urging the condiment container against the wall. A slot is formed in the wall above the slit formation. The slot is configured to receive and hold the lip of the condiment container.

In accordance with still yet a further feature of the invention the slits have a length that defines a loop distance. The loop distance is the largest distance between the wall and the loop. The loop distance is less than an outside diameter of the condiment container.

Other features which are considered as characteristic for the invention are set forth in the appended claims.

Although the invention is illustrated and described herein as embodied as a food container, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 6:
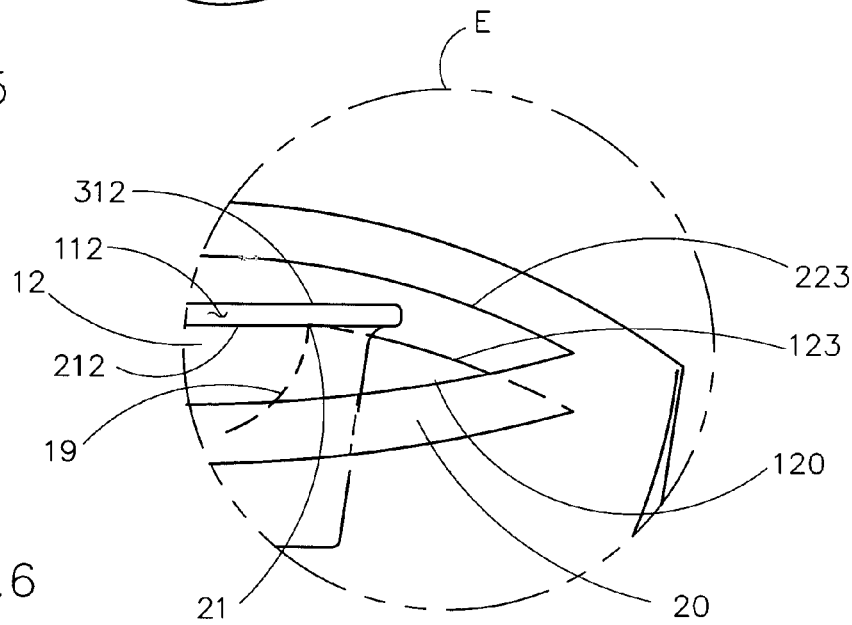
FIG. 6 is an enlarged partial view of detail "E" of FIG. 5 of the food container according to the invention.
Figure 7:
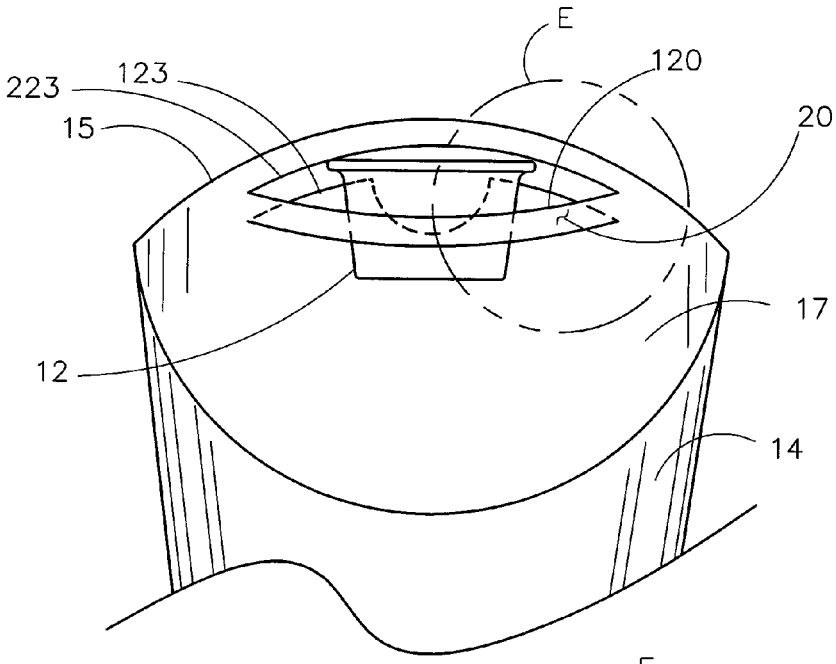
FIG. 7 is a front view of the food container according to the invention with the condiment container held in an upper position inside the food container.
Figure 8:
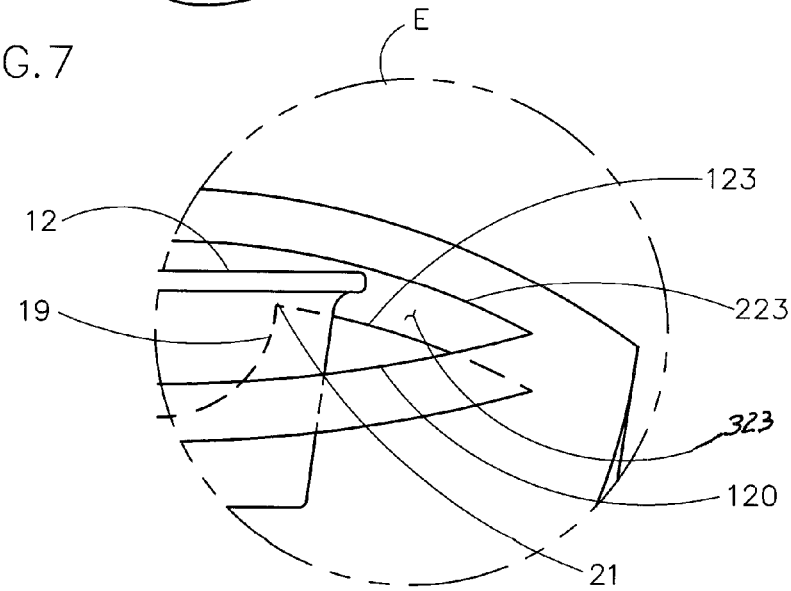
FIG. 8 is an enlarged partial view of detail "F" of FIG. 7 of the food container according to the invention.

Referring now to the figures of the drawing in detail and first, particularly, to FIGS. 1-4 which illustrate the food container 10 for holding food 11 and a condiment container 12 for containing condiment(s) 13. As seen in FIG. 6, the condiment container 12 has a lip 112 with a lower lip edge 212. The condiment container also has a top edge 312.

Figure 1:
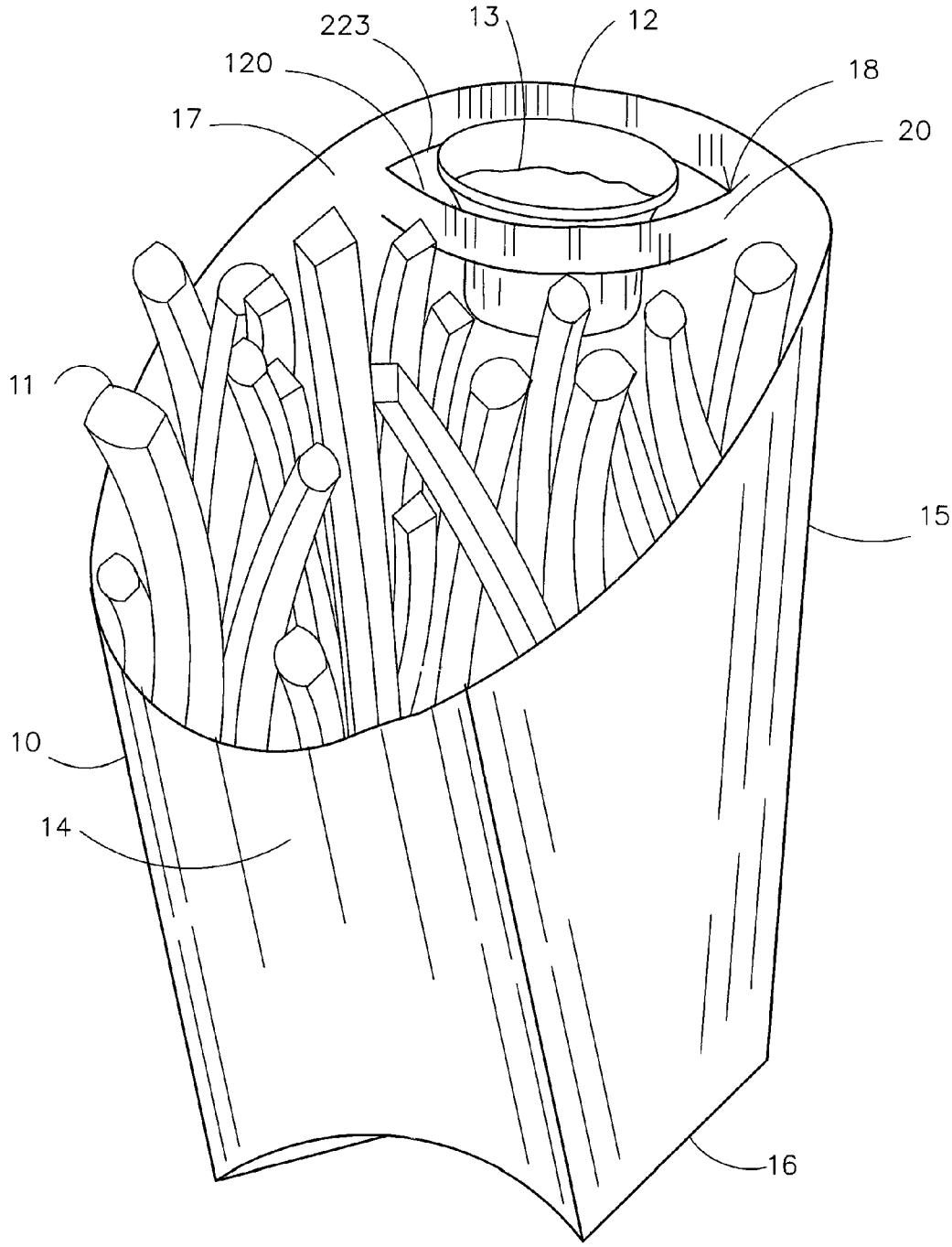
FIG. 1 is a perspective view of the food container according to the invention.
Figure 2:
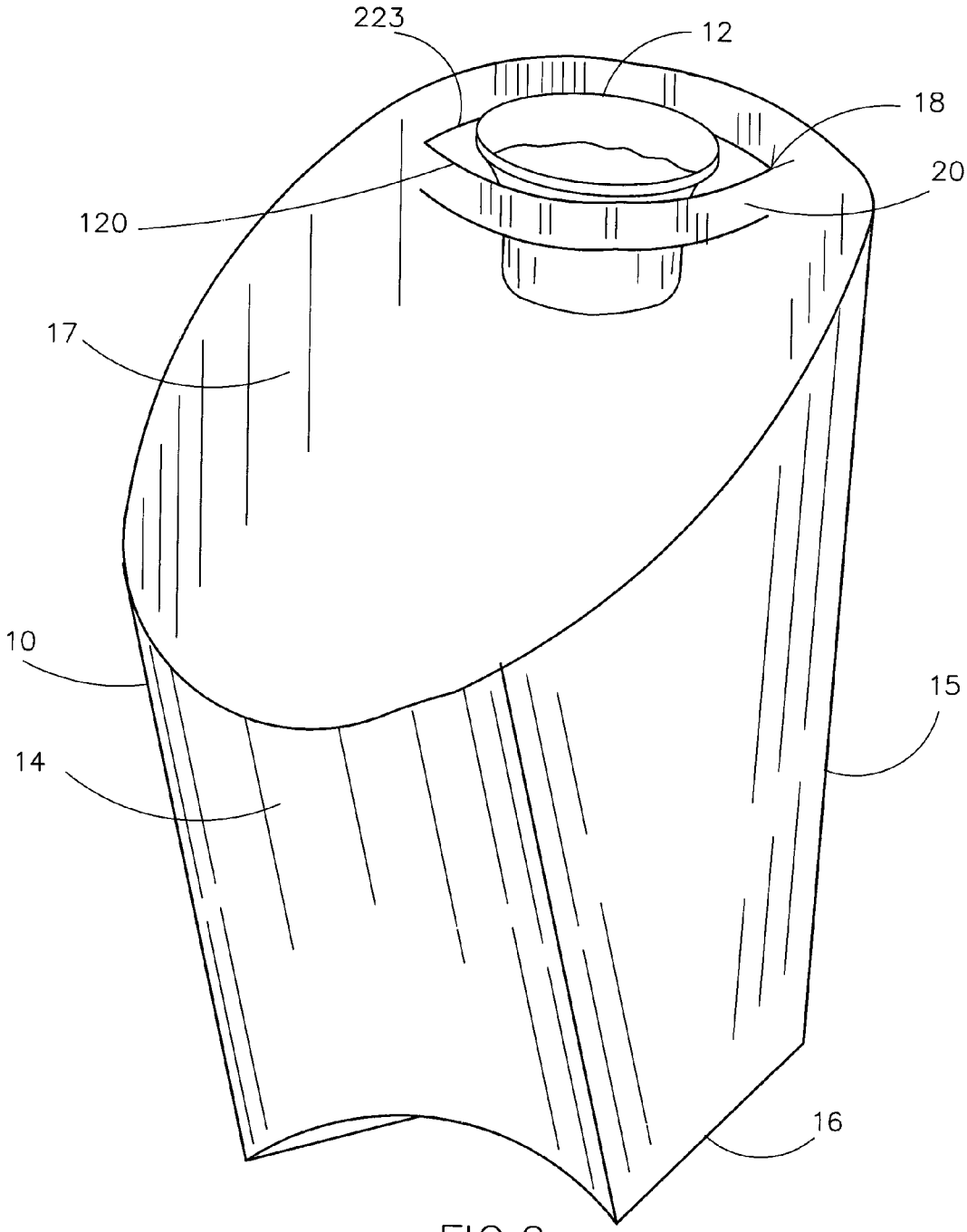
FIG. 2 is another perspective view of the food container according to the invention.

The food container 10 has a front wall or panel 14 that extends to a back wall or panel 15, and a bottom 16. Together, the front wall 14, the back wall 15, and the bottom 16 defining an enclosure or containment space 17 where the food, such as the French fries 11 shown in FIG. 1 are placed. The food container may also include sidewalls between the front wall 14 and the back wall 15. The food container may have one continuous round wall. The shape of the container itself is not critical. The food container 10 may be constructed from a unitary blank of material or may be constructed by multiple blanks.

The food container 10 contains a cutout formation 18 shown in the upper part of the back wall 15. The cutout formation 18 has two substantially parallel slits 23. The slits 23 may have a profile that is substantially flat or that is convex towards the top of the food container 10. The direction or absence of a curvature in the slits 23 does not affect the overall performance of the food and condiment container combination as long as they create a ring like structure when extended inward that is able to support the condiment container 12. The slits 23 define a loop 20 that is pressed into the containment space 17. The loop 20 projects from the wall at the ends of the slits 23 and forces the condiment container 12 against the wall 15. The slits 23 may be provided completely within a single wall or they may span adjacent walls of the food container 10.

The slits 23 define a first wall ledge 123, a second wall ledge 223, and a slot 323. The loop 20 has a loop edge 120. The slits 23 are spaced apart from each other at a distance C, which allows the lower lip edge 212 to be supported by the first wall ledge 123 as the condiment container 12 is held by the loop 20 and the lip 112 projects into the slot 323. This is particularly advantageous when a user is applying force to the condiment container 12, such as when fries are dipped into the condiment 13. The distance C also must be of a size, which allows the loop edge 120 to engage the lower lip edge 212 to help support the condiment container. In other words, the dimension C cannot be excessively large. The second wall ledge 223 engages the top edge 312 of the condiment container 12 for preventing the condiment container 12 from being removed in direction toward the top of the food container 10.

Figure 3:
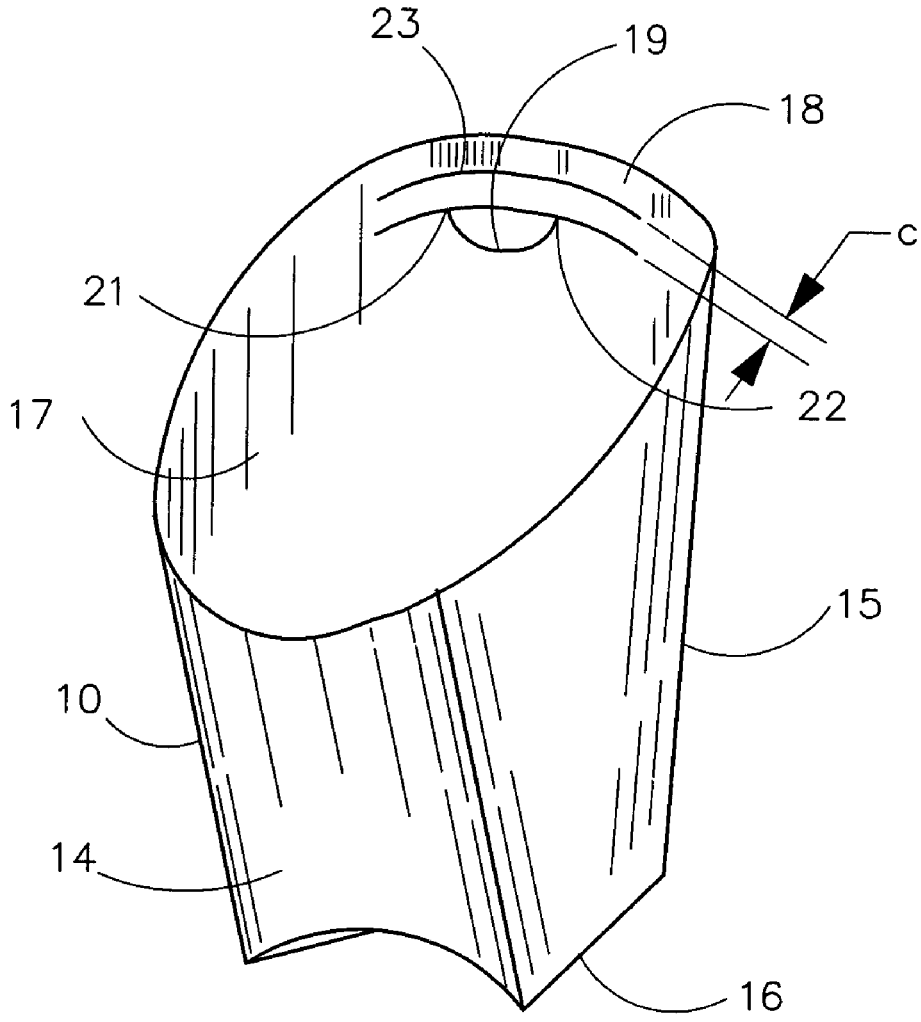
FIG. 3 is a perspective view of the food container according to the invention showing the slit formation in the food container.
Figure 4:
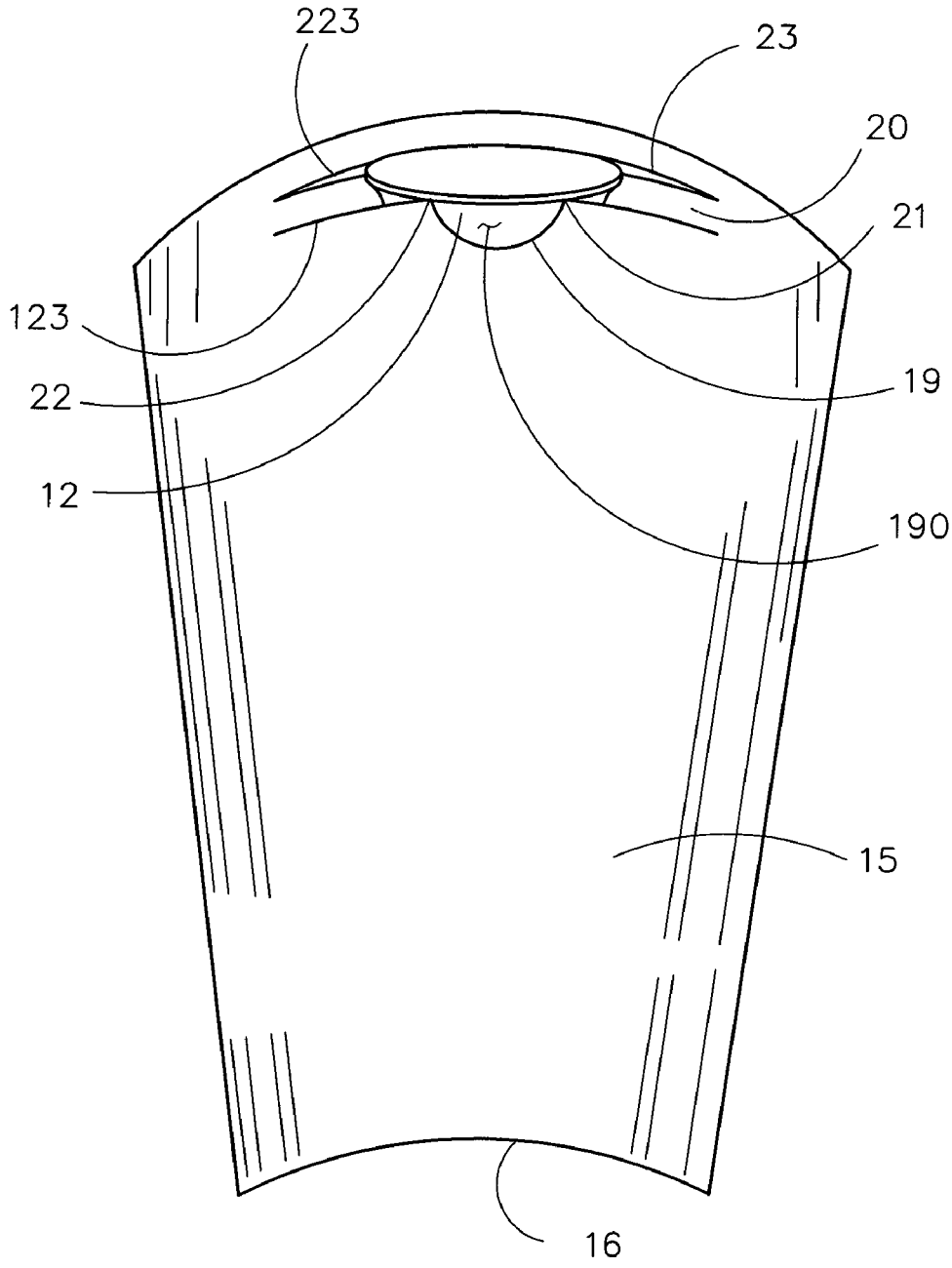
FIG. 4 is a rear view of the food container according to the invention with the condiment container held inside the food container.
Figure 5:
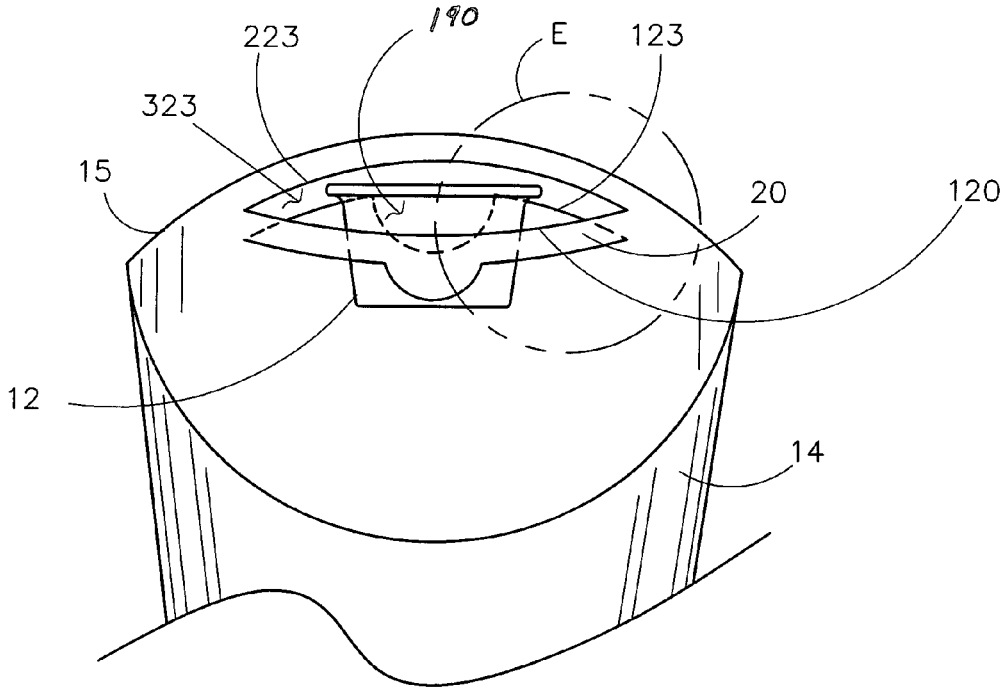
FIG. 5 is a front view of the food container according to the invention with the condiment container held in a lower position inside the food container.

As is shown in FIG. 3 the lower slit 23 can have semi-circular slit 19 located in the center of the lower slit 23. The semi-circular slit 19 results in the slot 323 having a semi-circular opening 190. The opening 190 provides the necessary space for a finger of a user to push the loop 20 into the containment space 17. As shown in FIG. 5, the loop 20 may have a tab 191 attached thereto as a result of the semi-circular slit 19 (if the slit 19 breaks the continuity of the lower slit 23). The tab 191 prevents the fingertip from contacting the content of the food container. As shown in FIG. 3, the semi-circular slit 19 does not interrupt the lower slit 23, in this case the tab 191 is removed and discarded. Although the slit 19 is disclosed as a semi-circle, any other shape, which permits a finger to push the loop into the containment space 17 is acceptable. It is also possible for the semi-circular slit 19 to be located in the center of the upper slit 23.

If the semi-circular slit 19 is provided, when the loop 20 is pushed inward, the cutout/slit formation 18 defines two corners 21 and 22 created by the semi-circular cutout 19. The two corners 21 and 22 support the lower lip edge 212 of the condiment container 12 as the condiment container 12 is urged against the wall 15 by the loop 20 and as the lip 112 projects into the slot 323.

Figure 9:
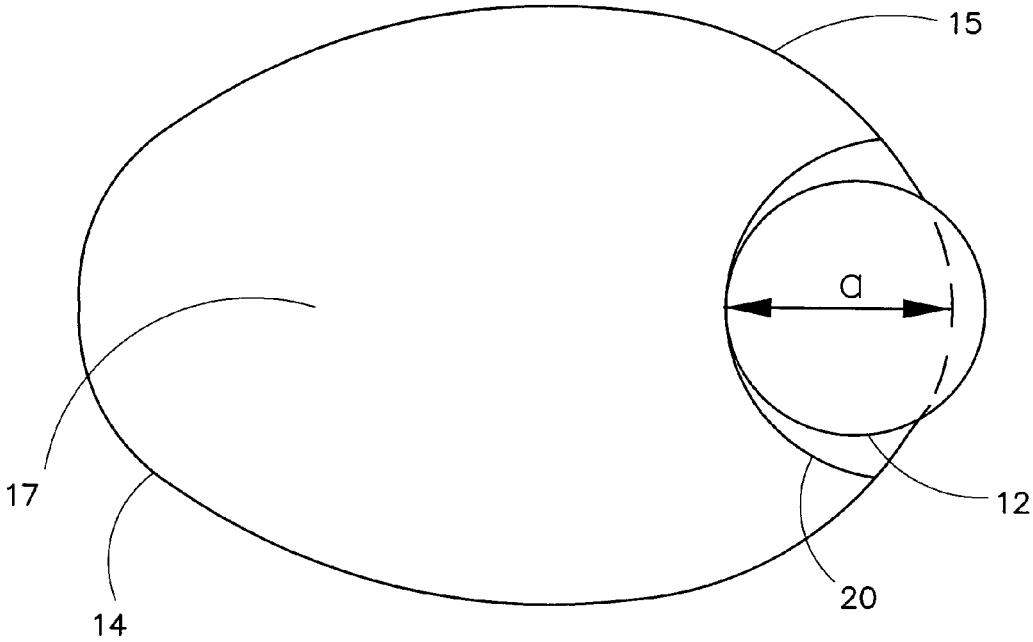
FIG. 9 is a top plan view of the food container according to the invention with the condiment container.
Figure 9:
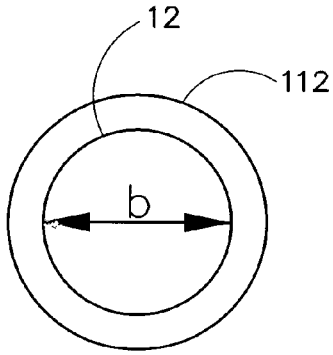

As shown in FIG. 9 the condiment container 12 has a diameter b and the loop 20 to the wall defines a distance a. The maximum size of distance a, is less than the diameter b of the condiment container. This ensures that the condiment container will be securely held in place by forcing the lip 112 of the condiment container 12 into the slot 323.

Figure 10:
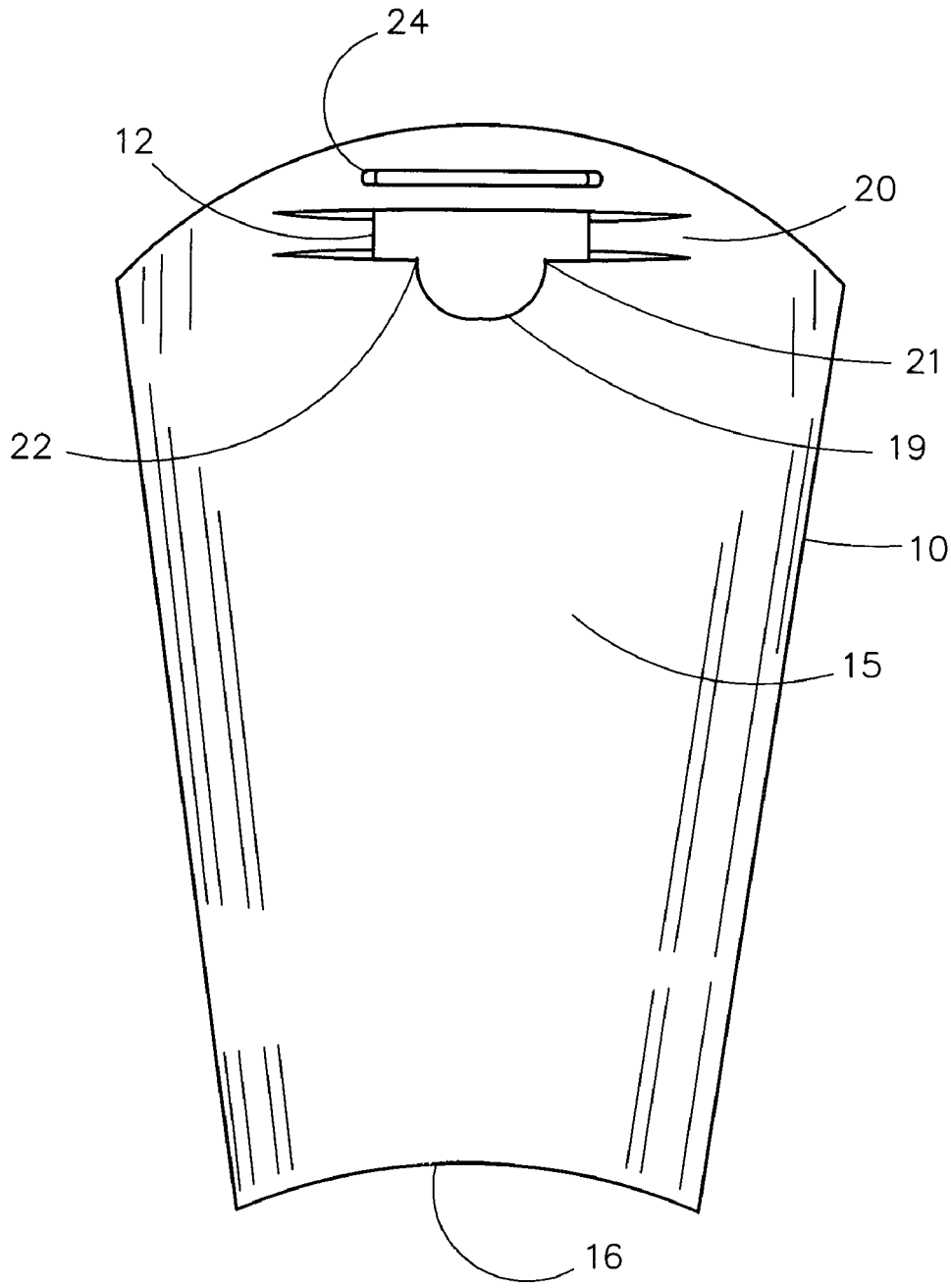
FIG. 10 is a rear view of another embodiment of the food container according to the invention with the condiment container held inside the food container.
Figure 11:
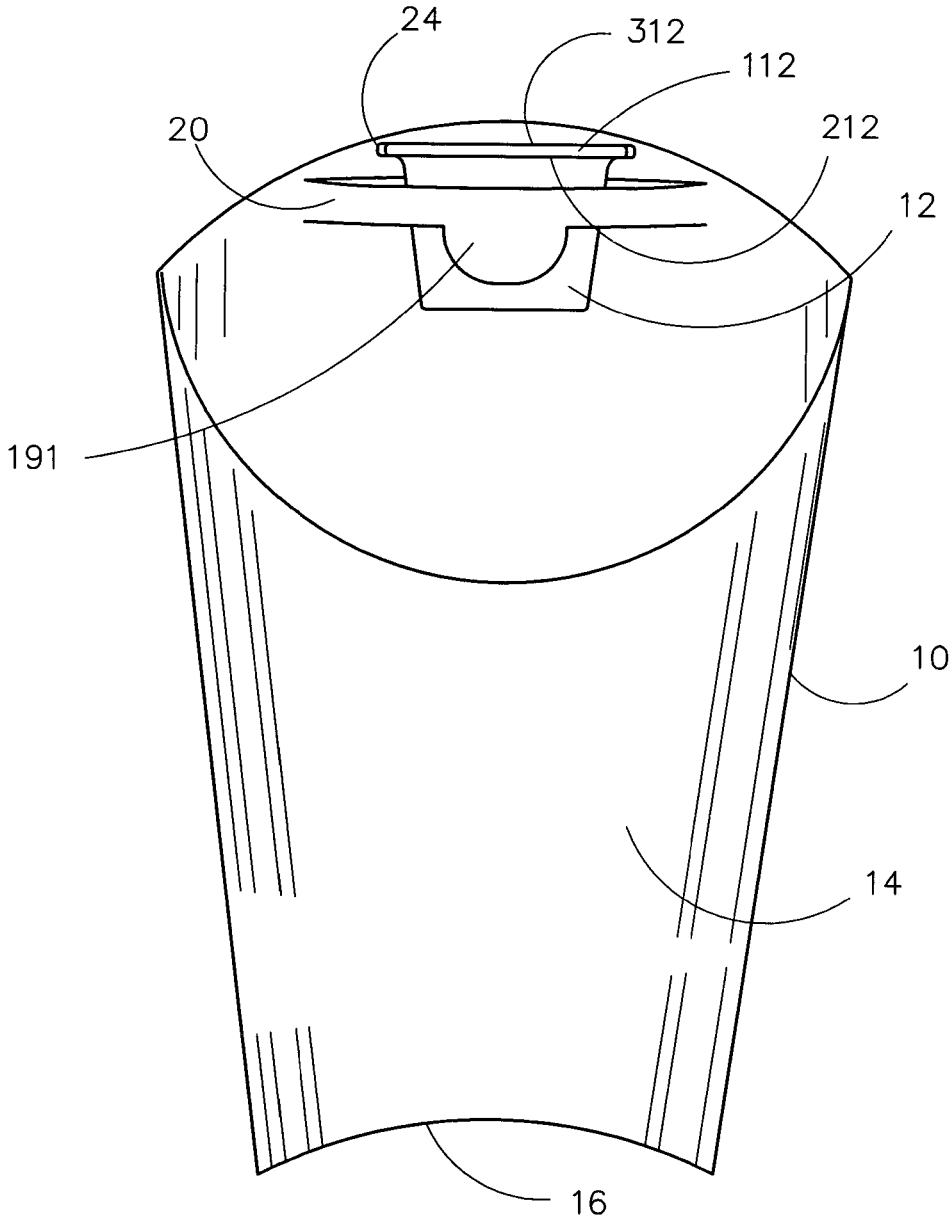
FIG. 11 is a front view of the embodiment of FIG. 10 of the food container according to the invention with the condiment container held inside the food container.

FIGS. 10 and 11 show another embodiment of the present invention, in which an additional slot 24 is formed in the wall above the slit formation 18. The additional slot 24 has a width which corresponds to a thickness of the lip 112 of the condiment container 12 so that the loop 20 causes the lip 112 to be pushed into and secured by the additional slot 24. This ensures that the condiment container 12 will be securely held in place for preventing the condiment container 12 from falling down or moving up.

We claim:

1. A food container in combination with a condiment container having an outwardly projecting lip, a lower lip edge and a top edge, the food container comprising:

at least one wall;

a bottom connected to said wall for defining a containment space;

a slit formation formed in said wall, said slit formation having a lower slit and an upper slit substantially parallel to said lower slit, said slits defining a loop having an upper edge, a lower edge and a surface extending from said upper edge to said lower edge, said loop being displaceable into said containment space for supporting the condiment container by urging the condiment container against said wall with said surface of said loop engaging the condiment container below the lower edge of the lip, said lower slit defining a wall lower ledge disposed for supporting the lower lip edge of the condiment container.

2. The food container according to claim 1, wherein said upper slit defines a loop edge and is spaced from said lower slit to allow said loop edge to engage the lower lip edge.

3. The food container according to claim 1, wherein said upper slit defines a wall upper edge configured to engage the top edge of the condiment container when the condiment container is held in said containment space by said loop.

4. The food container according to claim 1, wherein said slits have a length that defines a loop distance, said loop distance is the largest distance between said wall and said loop, said loop distance is less than an outside diameter of the condiment container.

5. The food container according to claim 1, wherein said lower slit includes a semi-circular slit at a middle of the lower slit, said semi-circular slit defining an opening in the wall that allows a finger to push said loop into said containment space.

6. The food container according to claim 5, wherein said semi-circular slit defines a tab on said loop.

7. The food container according to claim 5, wherein said semi-circular slit and said lower slit define a removable tab.

8. The food container according to claim 1, wherein said at least one wall is a plurality of connected walls, said slits being confined to one of said plurality of walls.

9. The food container according to claim 5, wherein said semi-circular slit defines two points on said wall at said lower slit, said points positioned to support the lower lip edge of the condiment container.

* * * * *